US007641007B2

(12) United States Patent
Radke et al.

(10) Patent No.: US 7,641,007 B2
(45) Date of Patent: Jan. 5, 2010

(54) DYNAMIC BLADE DISTANCE RATIO SYSTEM AND METHOD

(75) Inventors: Daniel Dean Radke, Dubuque, IA (US); James Arthur Nagorcka, Tarrington Victoria (AU); Lyal Douglas Allen, Hamilton Victoria (AU)

(73) Assignee: Deere & Company, Moline, IL (US)

( * ) Notice: Subject to any disclaimer, the term of this patent is extended or adjusted under 35 U.S.C. 154(b) by 482 days.

(21) Appl. No.: 11/286,726

(22) Filed: Nov. 23, 2005

(65) Prior Publication Data

US 2006/0124329 A1 Jun. 15, 2006

Related U.S. Application Data

(60) Provisional application No. 60/631,563, filed on Nov. 29, 2004.

(51) Int. Cl.
*B62D 55/116* (2006.01)

(52) U.S. Cl. ..... 180/9.52; 305/134

(58) Field of Classification Search ..... 180/9.1, 180/9.5, 9.52; 305/132, 134, 141
See application file for complete search history.

(56) References Cited

U.S. PATENT DOCUMENTS

| | | | | |
|---|---|---|---|---|
| 3,182,741 | A * | 5/1965 | Roach | 180/9.5 |
| 3,677,427 | A * | 7/1972 | Allen | 414/697 |
| 3,763,938 | A | 10/1973 | Brodersen | 172/789 |
| 3,899,028 | A | 8/1975 | Morris et al. | 172/4.5 |
| 3,907,041 | A | 9/1975 | Manor | 172/780 |
| 3,974,699 | A | 8/1976 | Morris et al. | 73/432 |
| 3,986,563 | A | 10/1976 | Stubben | 172/793 |
| 4,041,623 | A * | 8/1977 | Miller et al. | 37/382 |
| 4,053,017 | A | 10/1977 | Gill et al. | 172/4.5 |
| 4,061,194 | A | 12/1977 | McCanse | 172/447 |
| 4,088,236 | A | 5/1978 | Moore | 214/90 |
| 4,124,080 | A | 11/1978 | McCanse | 172/447 |
| 4,213,507 | A | 7/1980 | Horrer et al. | 172/784 |
| 4,340,126 | A | 7/1982 | Larson | 180/305 |
| 4,635,730 | A | 1/1987 | Larsson | 172/788 |
| 4,696,350 | A | 9/1987 | Ruhter et al. | 172/793 |
| 4,807,461 | A | 2/1989 | Brimeyer et al. | 172/793 |
| 5,074,061 | A | 12/1991 | Thompson | 37/129 |
| 5,549,412 | A | 8/1996 | Malone | 404/84.1 |
| 5,762,446 | A | 6/1998 | Manatt et al. | 404/75 |
| 5,775,438 | A | 7/1998 | Confoey et al. | 172/831 |
| 5,921,706 | A | 7/1999 | Manatt et al. | 404/72 |
| 6,164,399 | A * | 12/2000 | Bays | 180/9.5 |
| 6,322,287 | B1 | 11/2001 | Yelton | 404/118 |
| 6,382,873 | B1 | 5/2002 | Mulders et al. | 404/128 |
| 6,691,795 | B2 | 2/2004 | L'Abbe | 172/787 |
| 2002/0162669 | A1 | 11/2002 | L'abbe | 172/787 |

* cited by examiner

*Primary Examiner*—Anne Marie M. Boehler

(57) ABSTRACT

The blade ratio of an articulated work vehicle with multiple tracks is adjusted by shifting a load from the weight of the vehicle toward the front or rear of one or more of the tracks. The load may be shifted through the actuation of a hydraulic cylinder that applies a biasing load between a frame on which a track frame is mounted and a front or rear portion of the track frame.

9 Claims, 5 Drawing Sheets

50
50'
50m
200
50a
50a'
50d
50d'
50c
50c'
50h
50h'
50k
50f
50g
50g'
50b
50b'
50b"
50e
56
56'
56"
57
57'
57"
55
58
Controller
53'
Switch
Control
53"
54
59
2
53
1
52'
52
51
50"

DYNAMIC BLADE DISTANCE RATIO SYSTEM AND METHOD

This document claims priority based on U.S. provisional; application Ser. No. 60/631,563, filed Nov. 29, 2004, and entitled DYNAMIC BLADE DISTANCE RATIO SYSTEM AND METHOD, under 35 U.S.C. 119(e).

FIELD OF THE INVENTION

The invention relates to blade distance ratio as a factor in the grading ability of dozers. More specifically, it relates to a system and method for dynamically adjusting the blade distance ratio on a four track articulated dozer.

BACKGROUND OF THE INVENTION

Current market trends indicate that crawler operators are using their machines for more finish grading work than has historically been done. Thus the need for dozers that can competently grade is growing. To support this trend, manufacturers continue to improve the machines ability to perform this work to the operators expectations.

Key contributors of the dozers finish grading capability include such factors as machine balance, weight distribution, track length on ground, machine rigidity, and the location of the blade relative to the track. Locating the blade closer to the tracks increases the machine stability, and makes the machine easier to operate. The ability to minimize this distance is limited on dozers that have the ability to angle their blade because the blade must have adequate clearance to the tracks in all positions.

The blade distance ratio is commonly used as an indicator of a dozers grading ability. The blade distance ratio is determined by dividing the distance from the rear track roller to the blade (RTBD) by the effective track length on ground (ETL), i.e. Blade Distance Ratio=RTBD/ETL.

SUMMARY OF THE INVENTION

The exemplary embodiment of the invention described herein is applied to a crawler dozer with 4 independent tracks. In this configuration, the tracks are mounted such that they can move in a way that they can follow the contour of the ground. Each of the tracks pivots about a drive wheel. The blade distance ratio in this case would be best described as the (distance between the rear track pivot and the blade) divided by the (distance between the front and rear track pivots). In the case of a wheeled dozer, the latter term would be the wheel base.

In order to have a uniform ground pressure for the tracks of the exemplary embodiment, the pivot to the frame is located near the fore-aft center of the track. The negative consequence of this arrangement is that the distance from the blade to the center of the front weight bearing member is greater than would be achieved with a conventional crawler.

The invention improves the machine performance, i.e., the machine's ability to grade, by reducing the distance between the blade and the center of force under the front track system. This is accomplished by adding a hydraulic cylinder between the track frame and the track mounting frame which can increase the down-force on the front of the track frame. The cylinder is hydraulically connected to an accumulator and pressure regulating system so that the track can rotationally move around its mounting pivot and maintain contact with the ground.

This system can be actuated by the operator from the operators station when desired. When this system is activated, the cylinder exerts a torque on the track frame that creates an increased downward force at the front of the track, and a reduced force at the rear of the track. This subsequently causes an increased ground pressure on the front of the track, and a reduced ground pressure at the rear of the track. The amount of force is approximately proportional to the hydraulic cylinder force which can be adjustably controlled by the operator, or preset by the manufacturer.

An additional benefit of this system is that it enables the operator to artificially increase the downforce at the front of the track. In certain soil conditions, this can increase the tractive effort of the machine by forcing the track lug into the ground deeper than would be achieved without this feature enabled. The remainder of the track would then have a packed track to run in. This increased soil density under the track would enable the track to exert higher pull forces than would be otherwise achievable.

DETAILED DESCRIPTION

Figure 1:
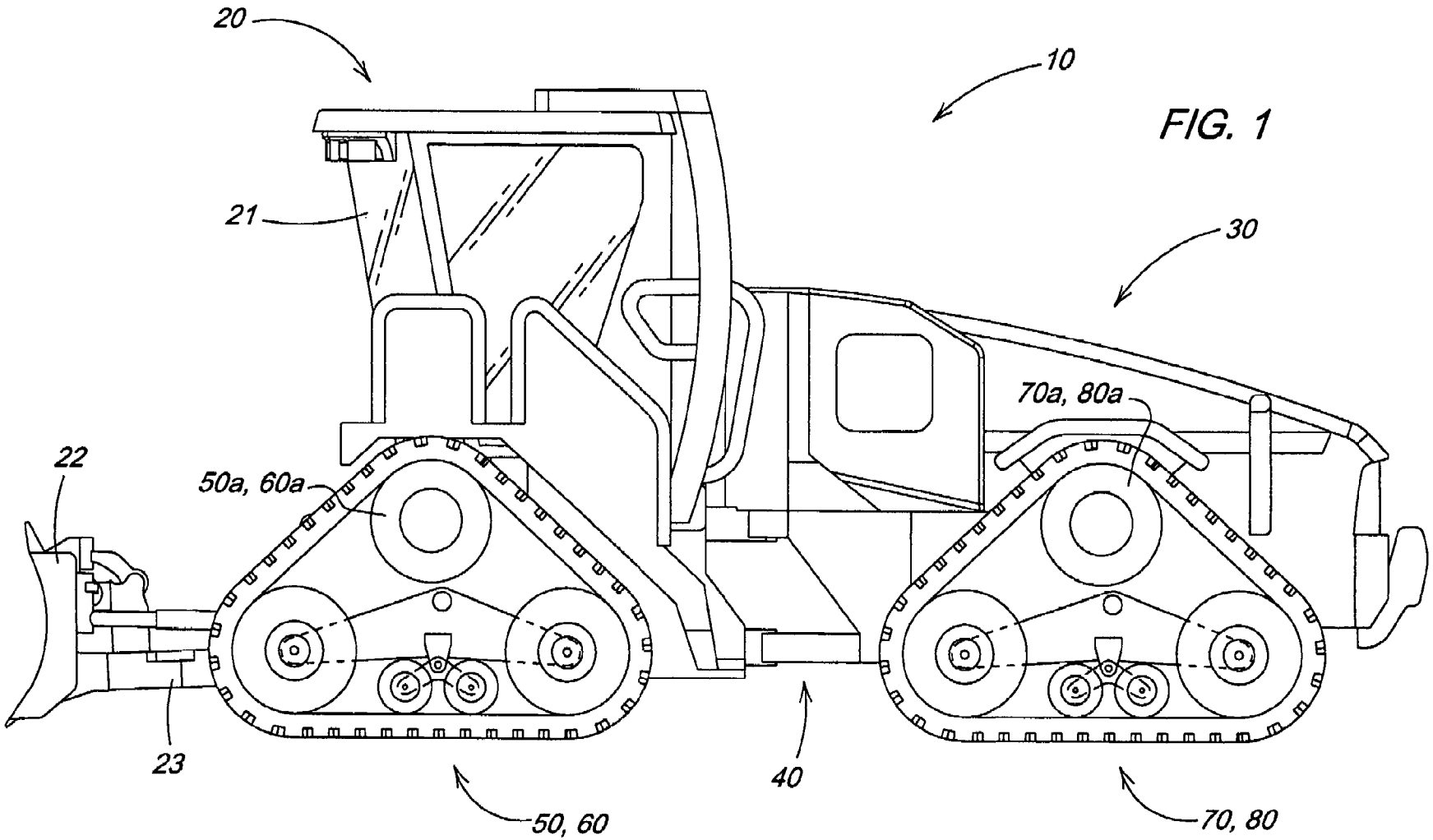
FIG. 1 is a side view of a work vehicle in which the invention may be used.
Figure 2:
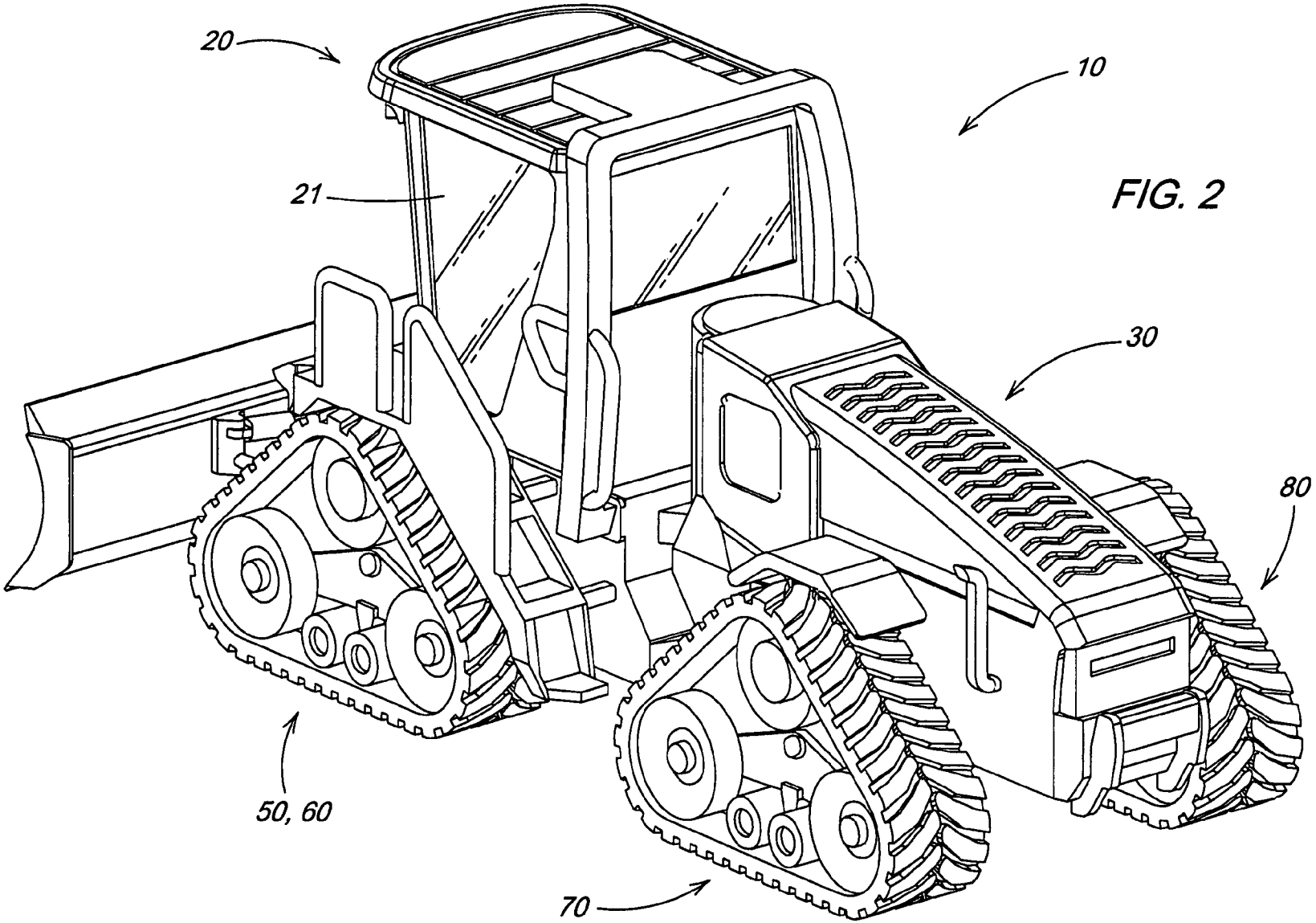
FIG. 2 is an elevated oblique view of a rear of the vehicle illustrated in FIG. 1.

FIGS. 1 and 2 illustrate a vehicle in which the invention may be used. The particular vehicle illustrated in FIGS. 1 and 2 is a four track articulated dozer 10 having a front portion 20 a rear portion 30; an articulation mechanism 40 between the front portion 20 and the rear portion 30; first track systems 50, 60; and second track systems 70, 80. The front portion 20 includes a blade 22 and a blade mounting frame 23 as well as an operator cab 21.

Figure 3:
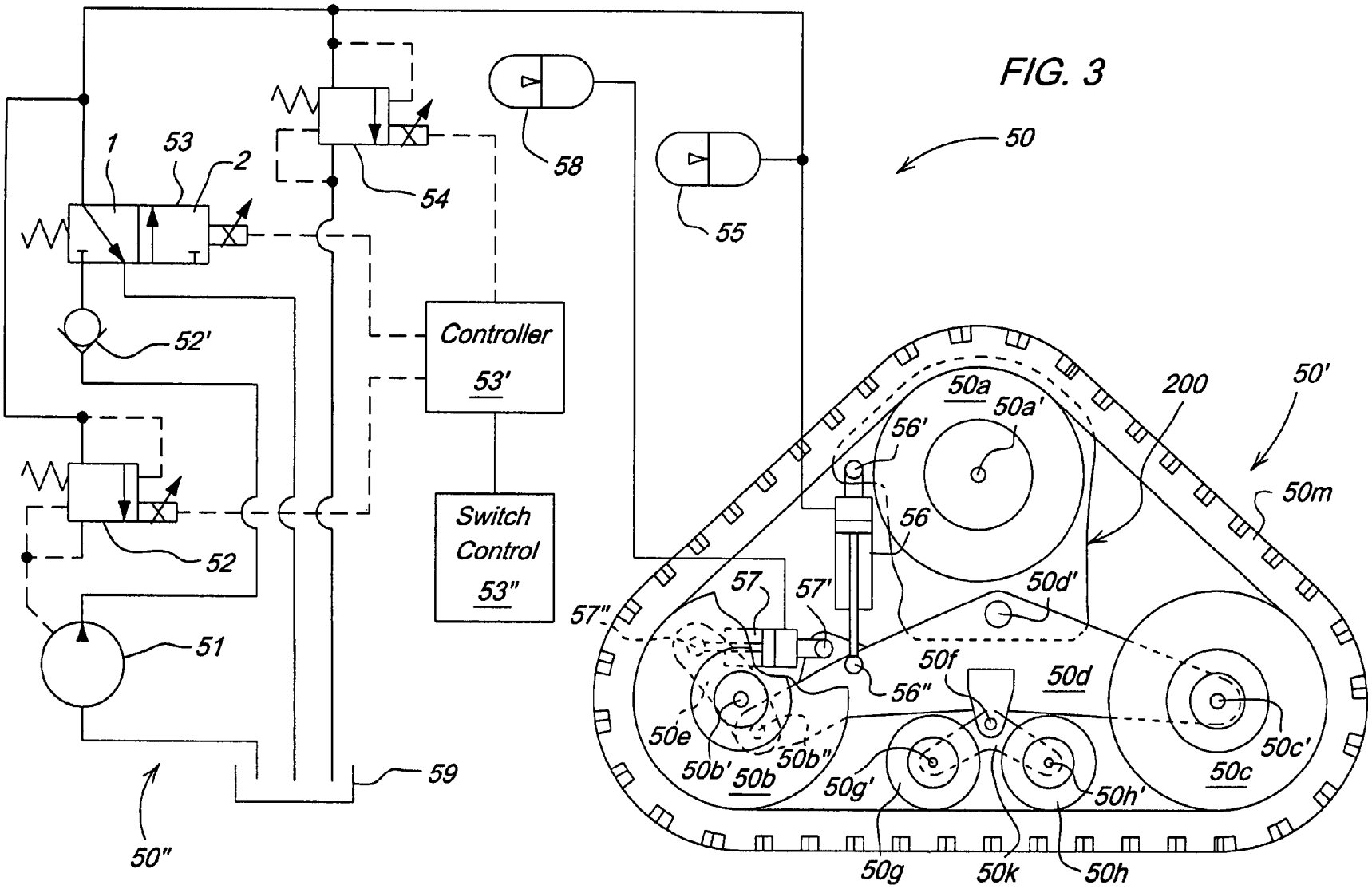
FIG. 3 is a schematic of a front track drive illustrated in FIG. 1.

FIG. 3 is a schematic of an exemplary embodiment of the invention. Included is an exemplary embodiment of the track system 50 which includes a track assembly 50' and a hydraulic circuit 50". The track assembly 50 is as illustrated in FIG. 3. A track frame 50*d* is pivotally mounted at track frame mounting pivot 50*d*' to a mounting frame 200. A drive wheel 50*a* is also pivotally mounted to the mounting frame 200 at drive wheel pivot 50*a*'. A first main idler 50*b* is pivotally attached to tension link 50*e* at first main idler pivot 50*b*' and the tension link 50*e* is pivotally attached to the track frame 50*d* on a first side of the track frame mounting pivot 50*d*' at tension link pivot 50*b*". A second main idler 50*c* is pivotally attached to the track frame 50*d* on a second side of the track frame mounting pivot 50*d*' at second main idler pivot 50*c*'. A tensioning cylinder 57 is pivotally connected to the track frame 50*d* at tensioning cylinder pivot 57' and pivotally connected to the tensioning link at cylinder link pivot 57". A biasing cylinder 56 is pivotally mounted to the mounting frame 200 at biasing cylinder mounting pivot 56' and pivotally mounted to the track frame 50*d* at track frame biasing pivot 56".

Minor idler rollers 50*g* and 50*h* are pivotally connected to minor rocker beam 50*k* at minor roller pivots 50*g*' and 50*h*' respectively. The minor rocker beam 50*k* is pivotally mounted to the track frame 50*d* at rocker beam mounting pivot 50*f*. As illustrated in FIG. 3, the minor roller pivots 50*g*' and 50*h*' are mounted on first and second sides of rocker beam mounting pivot 50*f*, respectively.

A first side of a track 50*m* contacts the drive wheel 50*a*, the first main idler 50*b*, the second main idler 50*c*, the first minor idler 50*g* and the second minor idler 50*h*. A second side of the track contacts the ground for purposes of vehicle propulsion. As illustrated in FIG. 3, the track 50*m* assumes a triangular appearance as the first side contacts and conforms to the drive wheel 50*a* and the first and second main idlers 50*b* and 50*c* on front and rear portions of the track assembly, respectively.

Controlling the biasing cylinder 56 is exemplary hydraulic circuit 50" which includes: a hydraulic pump 51; a load sense actuating valve 52; a pressure reducing valve 53 in communication with the hydraulic pump 51 and fluid reservoir 59; a check valve 52' in communication with the pressure reducing valve 53; an electrically adjustable pressure relief valve 54 in communication with the pressure reducing valve 53; a first gas charge accumulator 55 in communication with the biasing cylinder 56 as well as in communication with the adjustable pressure relief valve 54 and the pressure reducing valve 53.

The pressure relief valve 54 is adjustable. In this particular embodiment, it is adjustable from 70 bar to 140 bar. The pressure relief valve 54, in practice, is set 10 bar above the setting of the pressure reducing valve 53. The pressure reducing valve 53 and the pressure relief valve 54 may be adjusted from the operator's cab 21 via a switch control 53" and a controller 53'.

The biasing cylinder 56 is actuated when a signal from the controller 53', prompted by a manipulation from the switch control 53" activates the pump load sense valve 52 and shifts the pressure reducing valve 53 from position (1) to position (2), thus exposing the pressure relief valve 54, the accumulator 55 and the biasing cylinder 56 to pressurized fluid from the pump 51. The pump 51 is driven by conventional means well known in the art.

Figure 4:
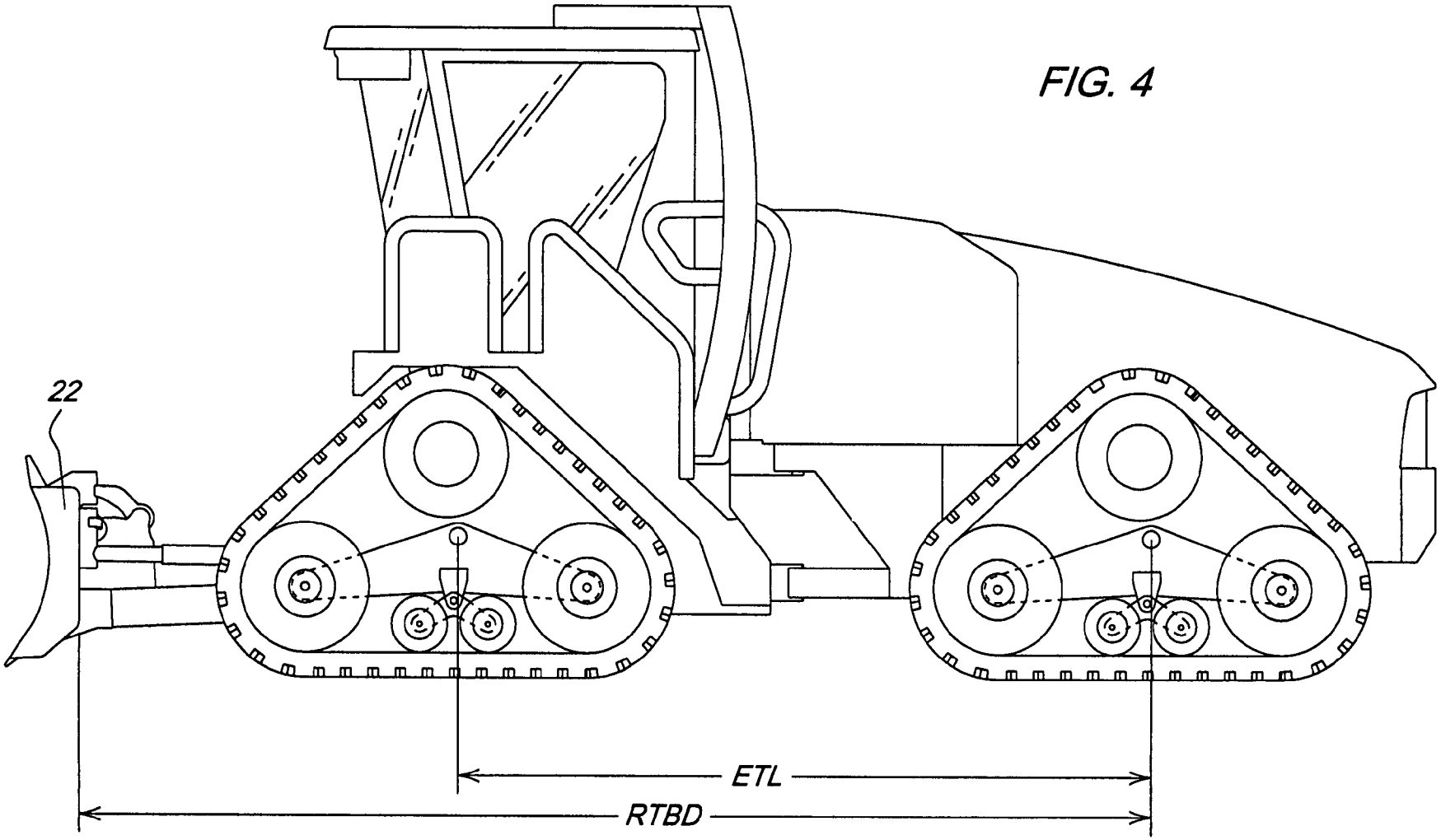
FIG. 4 illustrates the track length for calculating the blade ratio without the activation of the invention.
Figure 5:
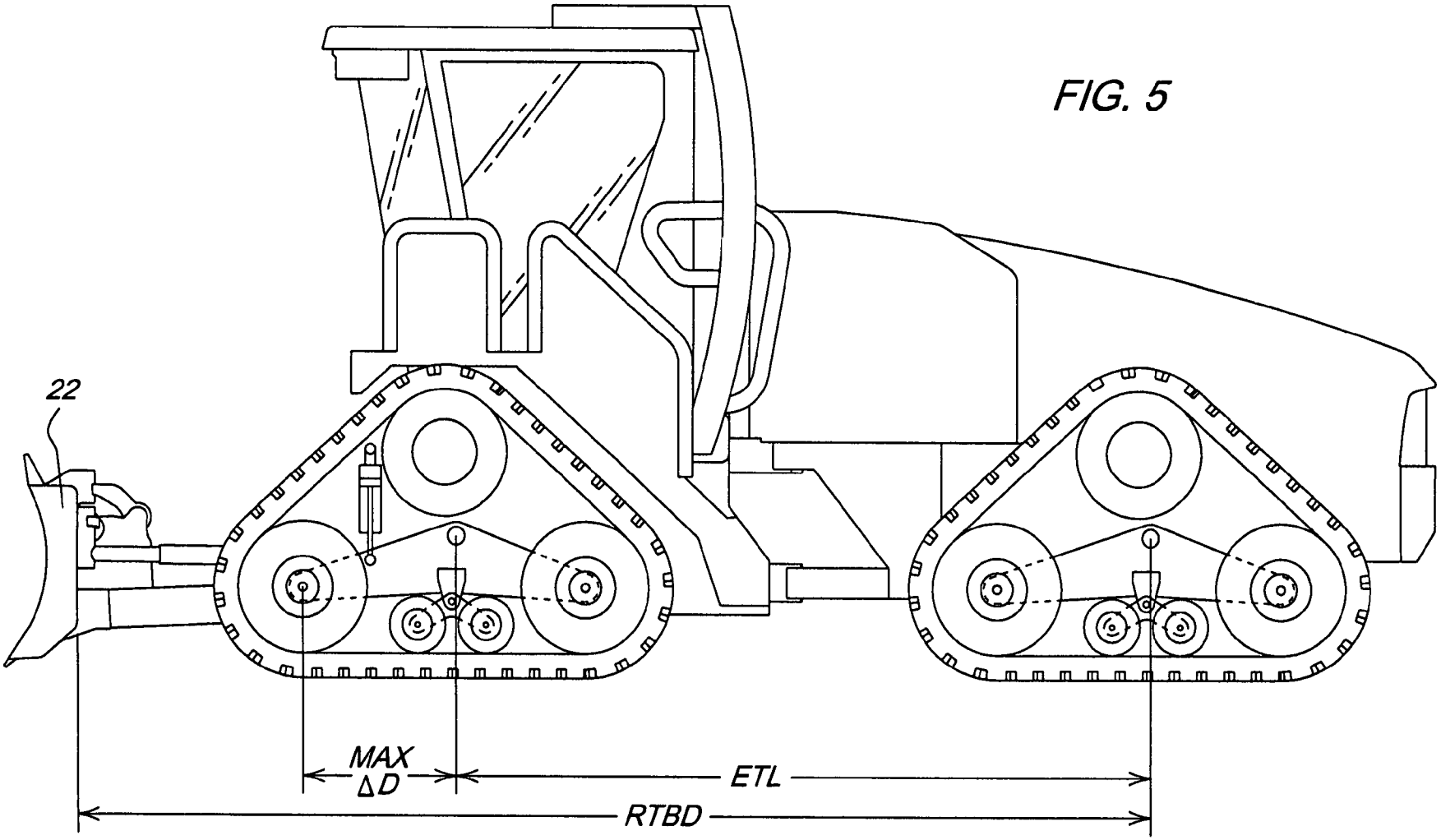
FIG. 5 illustrates the track length for calculating the blade ration when the invention is activated.

The blade ratio is improved as it decreases and moves toward a value of 1. FIG. 4 illustrates distances for blade distance ratio calculations for the vehicle of FIG. 1 without the invention activated and FIG. 5 illustrates distances for blade distance ratio calculations for the vehicle of FIG. 1 after the invention is activated. As is clearly illustrated the effective track length (ETL) increases by at least a distance between the track frame pivot 50*d*" and pivot 50*b*' for the first main idler 50*b* when the biasing cylinder 56 is actuated. The maximum increase in distance (ΔDmax) is illustrated in FIG. 5. The increase in distance (ΔD) depends upon the fluid pressure applied to the biasing cylinder 56. Such changes increase the grading ability of the dozer 10. Activation of the invention tends to shift the weight seen by the track assembly 50' toward the first main idler 50*b* the load seen by the ground is more concentrated which results in a greater amount of packing of the dirt under the track 50*m* and, consequently, greater traction.

Having described the illustrated embodiment, it will become apparent that various modifications can be made without departing from the scope of the invention as defined in the accompanying claims.

The invention claimed is:

1. A track system for a multi-track work vehicle, comprising:

a track having a first side and a second side;

a first idle roller engaging the first side of the track;

a second idle roller engaging the first side of the track;

a drive wheel engaging the first side of the track, the second side of the track engaging the ground between at least two of the first idle roller, the second idle roller and the drive wheel;

a biasing hydraulic cylinder, the biasing hydraulic shifting a load from a weight of the vehicle toward at least one of the first and second idle rollers when the actuator is activated; and a hydraulic circuit, the hydraulic circuit including a hydraulic pump, a pressure reducing valve having a first valve position and a second valve position, a pressure relief valve, an accumulator, a controller and a switch control, the switch control having a first switch position and a second switch position, the hydraulic circuit controlling the hydraulic cylinder by controlling a flow of pressurized hydraulic fluid to the biasing hydraulic cylinder.

2. The track system of claim 1, wherein the actuator is activated when the hydraulic circuit allows the pressurized hydraulic fluid to flow to the biasing hydraulic cylinder.

3. The track system of claim 2, wherein the second switch position causes the pressure reducing valve to move to the second valve position and allow the pressurized hydraulic fluid to flow to the hydraulic cylinder.

4. The track system of claim 3, wherein the controller causes the pressure reducing valve to move to the second valve position.

5. The track system of claim 1, wherein the first switch position allows the displacement valve to move to the first valve position and prevent the flow of pressurized hydraulic fluid to the hydraulic cylinder.

6. The track system of claim 1, wherein a pressure across the pressure relief valve is adjusted by the controller.

7. The track system of claim 6, wherein a pressure delivered to the hydraulic cylinder is controlled by the pressure relief valve and a preload on the accumulator.

8. The track system of claim 7, wherein a preload comprises a pre-charge.

9. A pivotable track system for a multi-track work vehicle, comprising:

a track assembly, including:

a track, a track frame, a first main idle roller engaging a first side of the track and pivotally attached to the tension link, a second main idle roller engaging the first side of the track and pivotally attached to the track frame, at least one minor idle roller engaging the first side of the track and pivotally attached to the track frame, a drive wheel engaging the first side of the track, a mounting frame, the track frame pivotally mounted to the mounting frame, the drive wheel pivotally mounted to the mounting frame, and a biasing cylinder, the biasing cylinder pivotally mounted to the mounting frame, the biasing cylinder pivotally mounted to the track frame, the biasing cylinder arranged to cause a load from a weight of the vehicle to shift toward the first main idle roller when the biasing cylinder is actuated; and a hydraulic circuit, including:

a hydraulic pump;

a load sense actuating valve;

a check valve;

a pressure reducing valve having at least two positions;

a pressure relief valve;

a first accumulator;

a second accumulator;

a controller;

a control switch having a first switch position and a second switch position; and a fluid reservoir, the load sense actuating valve in communication with the hydraulic pump, the first accumulator and the pressure reducing valve, the check valve in communication with the hydraulic pump and the pressure reducing valve, the pressure reducing valve in communication with the second accumulator, the pressure relief valve and the biasing cylinder, the controller adjusting a position of the pressure reducing valve, the controller adjusting a pressure reducing setting of the pressure reducing valve and the pressure relief setting of the pressure relief valve.

* * * * *